US007131235B2

(12) United States Patent
Hicks

(10) Patent No.: US 7,131,235 B2
(45) Date of Patent: Nov. 7, 2006

(54) CHILD BARRIERS

(75) Inventor: Robert James Hicks, Hemsby (GB)

(73) Assignee: Bettacare Limited, Surrey (GB)

( * ) Notice: Subject to any disclaimer, the term of this patent is extended or adjusted under 35 U.S.C. 154(b) by 268 days.

(21) Appl. No.: 10/479,569

(22) PCT Filed: Apr. 22, 2002

(86) PCT No.: PCT/GB02/01880

§ 371 (c)(1),
(2), (4) Date: Jul. 13, 2004

(87) PCT Pub. No.: WO02/099238

PCT Pub. Date: Dec. 12, 2002

(65) Prior Publication Data

US 2004/0238806 A1 Dec. 2, 2004

(30) Foreign Application Priority Data

Jun. 4, 2001 (GB) ..... 0113541.7

(51) Int. Cl.
*E06B 3/68* (2006.01)
*B25G 3/00* (2006.01)

(52) U.S. Cl. ..... 49/55; 49/50; 49/57; 49/463; 49/465; 403/17; 403/22

(58) Field of Classification Search ..... 49/50, 49/55, 57, 463, 465; 256/1, 73, 67; 403/13, 403/14, 17, 18, 22, 96, 109.4, 315, 317, 320, 403/377, 308
See application file for complete search history.

(56) References Cited

U.S. PATENT DOCUMENTS 2,286,755 A * 6/1942 Herskind et al. ..... 403/320
5,809,694 A * 9/1998 Postans ..... 49/57

FOREIGN PATENT DOCUMENTS

| | | |
|---|---|---|
| EP | 1 103 693 | 5/2001 |
| GB | 2 294 080 | 4/1996 |
| WO | 93/07352 | 4/1993 |

* cited by examiner

*Primary Examiner*—Daniel P. Stodola
*Assistant Examiner*—Victor MacArthur
(74) *Attorney, Agent, or Firm*—Reed Smith LLP

(57) ABSTRACT

A child barrier for installation in a passage or the like comprises a frame with two side portions (4) which, in use, are positioned adjacent the walls of the passage, each side portion (4) carrying one or more vertically spaced abutment members (20) for engagement with an adjacent wall. The abutment members on at least one of the side portions is connected thereto by an adjustment mechanism, each adjustment mechanism comprising an elongate threaded member (18), one end of which is connected to the associated abutment member (20) and the other end of which is longitudinally slidably received in the associated side portion. Each adjustment mechanism also includes an adjustment member (24) in screw threaded engagement with the threaded member (18). The adjustment member (24) and the associated side portion (4) of the frame afford respective surfaces opposed to one another, on one of which there is at least one resilient locking projection (28) and on the other of which there is at least one cooperating locking recess (34). At least one of the projection and recess has two inclined ramp surfaces (30, 32) extending in opposite circumferential directions of the threaded member. One of the ramp surfaces (30) is inclined at a relatively shallow angle to a plane (26) extending radially of the threaded member and the other ramp surface (32) is inclined at a relatively steep angle thereto.

8 Claims, 3 Drawing Sheets

CHILD BARRIERS

The present invention relates to child barriers, that is to say barriers of the type which may be selectively positioned and located in a passageway or the like in order to prevent access by children. Such barriers are frequently placed at the top or bottom of a stairway for safety purposes but can also be placed in a doorway to prevent access of children into a room. Such barriers may constitute a single integral unit or panel, e.g. comprising spaced slats or bars, but it is more usual for them to comprise a U-shaped frame whose upper portion is open and which defines an aperture in which a door or gate is received, pivotally connected to one or other side portion. The gate may usually be latched to the other side portion by a child-proof lock, that is to say a lock which may be readily opened by an adult but which children are generally unable to open.

Such barriers commonly comprise a frame with two side portions which, in use, are positioned adjacent the walls of the passage, each side portion carrying one or more vertically spaced abutment members for engagement with an adjacent wall. Since passageways, doorways and the like may be of a wide variety of widths, it is usual for the abutment members on at least one side of the barrier to be carried by an adjustment mechanism. Typically, each adjustment mechanism comprises an elongate threaded member, one end of which is connected to the associated abutment member and the other end of which is longitudinally slidably received in the associated side portion. Each adjustment mechanism includes an adjustment member, typically in the form of a knurled wheel or the like in screw threaded engagement with the threaded member. The adjustment member and the associated side portion of the frame afford respective engagement surfaces. In use, the adjustment member is rotated in the direction which will move it longitudinally towards the associated side portion of the barrier. When the two engagement surfaces are in contact, continued rotation moves the threaded member and thus the abutment member connected to its free end outwardly until it engages the adjacent wall. Further rotation of the adjustment member clamps the abutment member against the wall. When all the adjustment mechanisms have been tightened in this manner, the barrier is located in position and prevents the passage of a child.

As mentioned, it is common for such barriers to include a central door or gate which may be moved between an open position, in which adults and children may pass through it, and a closed position, in which it is commonly secured by a child-proof lock or latch. However, whilst the latch on the gate is commonly child-proof, the adjustment mechanisms are not and it is found that children have a tendency to play with the adjustment mechanisms and in doing so they frequently rotate the adjustment member. This can sometimes inadvertently or deliberately result in the securement of the barrier in the passageway being loosened to the extent that the barrier falls over or may be moved and this may pose a health or safety risk to the child.

It is therefore the object of the present invention to provide a child barrier of the type referred to above which is truly child-proof, that is to say whose gate, if such is provided, may not be opened by the child, and which also includes adjustment mechanisms which cannot be released by a child, thereby eliminating the risk that the barrier may unintentionally become loose and thus fall over or be removable, thereby permitting the passage of a child.

According to the present invention, a child barrier for installation in a passage or the like comprises a frame with two side portions which, in use, are positioned adjacent the walls of the passage, each side portion carrying one or more, and preferably two vertically spaced abutment members for engagement with an adjacent wall, the two abutment member(s) on at least one of the side portions being connected thereto by an adjustment mechanism, each adjustment mechanism comprising an elongate threaded member, one end of which is connected to the associated abutment member and the other end of which is longitudinally slidably received in the associated side portion, each adjustment mechanism also including an adjustment member in screw threaded engagement with the threaded member, the adjustment member and the associated side portion of the frame affording respective surfaces opposed to one another, on one of which there is at least one resilient locking projection and on the other of which there is at least one cooperating locking recess, at least one of the projection and recess having two inclined ramp surfaces extending in opposite circumferential directions of the threaded member, one of the ramp surfaces being inclined at a relatively shallow angle to a plane extending radially of the threaded member and the other ramp surface being inclined at a relatively steep angle thereto. It is preferred that the two opposed surfaces carry a plurality of locking projections and locking recesses, respectively.

Thus the opposing surfaces on the adjustment member and the associated side portion of the frame, which are in contact as the associated abutment member is urged into contact with an adjacent wall, carry one or more cooperating pairs of locking formations, that is to say a resilient locking projection and a cooperating locking recess. At least one of these includes two ramp surfaces extending in opposite circumferential directions, one of which is inclined at a relatively shallow angle to a radial plane and the other of which is inclined at a relatively steep angle. The shallow ramp is arranged on the leading side of the locking projection and/or locking recess, when the adjustment member is rotated in the tightening direction, that is to say in the direction in which the abutment member is moved outwardly, whilst the steep ramp is arranged on the trailing side thereof. In use, when the abutment member is initially brought into contact with the wall of the passage or the like, the two opposed surfaces are pressed into light contact. As rotation of the adjustment member continues, the contact pressure increases but tightening is possible because the shallow ramp on the or each resilient locking projection is compressed by engagement with the leading edge of the or each locking recess, thereby permitting the locking projection to pass over the recess. However, as tightening continues, this becomes progressively more difficult, and then impossible. When further tightening is not possible, it is found that unscrewing the adjustment member is not possible for a child but is nevertheless still possible for an adult. The reason for this is that the or each steep ramp surface comes into contact with the trailing edge of the or each locking recess and the fact that the angle of this ramp is greater than that of the shallow ramp means that the compressive force exerted on the or each locking projection is less and thus that the locking projections are unable to move out of the locking recesses without a relatively substantial torque being exerted on the locking member. Whilst an adult can exert such a torque, a child cannot.

It is preferred that the shape of the or each locking projection is complementary to that of the or each locking recess. This will mean that each projection and recess will have a relatively shallow ramp, e.g. extending at an angle of between 10° and 35° to the radial plane, and a steep ramp extending at e.g. 35° to 90° to the radial plane. It will, however, be appreciated that this is not essential and that the invention will still be operative if only one of the projection and recess are provided with such ramps.

The elongate threaded mechanism may be slidably received in a hole formed directly in the associated side portion of the frame but it is convenient if the hole is in fact formed in a fitting carried by the associated side portion of the frame, e.g. received in the manner of a push- or force-fitted plug in an open-ended retaining section forming a horizontal member of the frame. This fitting will then afford one of the two opposed surfaces and it is preferred that the fitting is made of resilient plastics material which will mean that the opposed surface on it and thus also the locking projection or projections or recess or recesses formed on or in it will also be made of resilient plastics material. It is also preferred that the adjustment member be made of resilient plastics material, though it will be appreciated that the adjustment member must afford a threaded hole and that whilst this thread could be formed directly in the plastics material, the desirability of this material being resilient means that this is generally inappropriate and that the screw thread is therefore preferably formed in a metallic nut which is positioned centrally and is substantially embedded in the plastics material.

As mentioned above, the barrier may be continuous but it is preferred that the frame is in fact of generally U-shape comprising two side portions connected by a base portion and defines an aperture in which a gate pivotally connected to one of the side portions is received. The gate will thus have hinges on one side and a lock, normally a child-proof lock, positioned on the other side by means of which the gate may be latched to the adjacent side portion of the frame. This child-proof lock of the gate may be of any known type.

The child-proof locking mechanism in accordance with the invention might therefore be thought of as essentially constituting a rotary ratchet. Tightening the ratchet in order to urge the abutment members against an adjacent wall is facilitated by the shallow ramps on the leading sides of the projections and/or recesses and by the resilience of the projections and optionally also of the material in which the recesses are formed. Rotation in the reverse direction is more difficult and requires the application of greater torque but is nevertheless possible as a result of the resilience of the locking projection and optionally also of the material in which the locking recesses are formed.

However, if the barrier is in the form of a gate, once the gate is opened, the U-shaped frame will have a certain resilience and it is readily possible to move the upper portions of the two arms of the U towards one another. This will further facilitate releasing the upper adjustment mechanism or mechanisms. However, this will not facilitate releasing the lower mechanisms which will be adjacent the base of the U and it is therefore likely in practice that there will be greater difficulty in releasing the lower mechanisms than the upper mechanisms. This may be compensated for by arranging for the dimension of the locking projections and recesses in the axial direction of the threaded member to be greater on the upper adjustment mechanisms than the lower adjustment mechanisms.

Further features and details of the invention will be apparent from the description of one specific embodiment which is given by way of example with reference to the accompanying drawings, in which.

Figure 2:
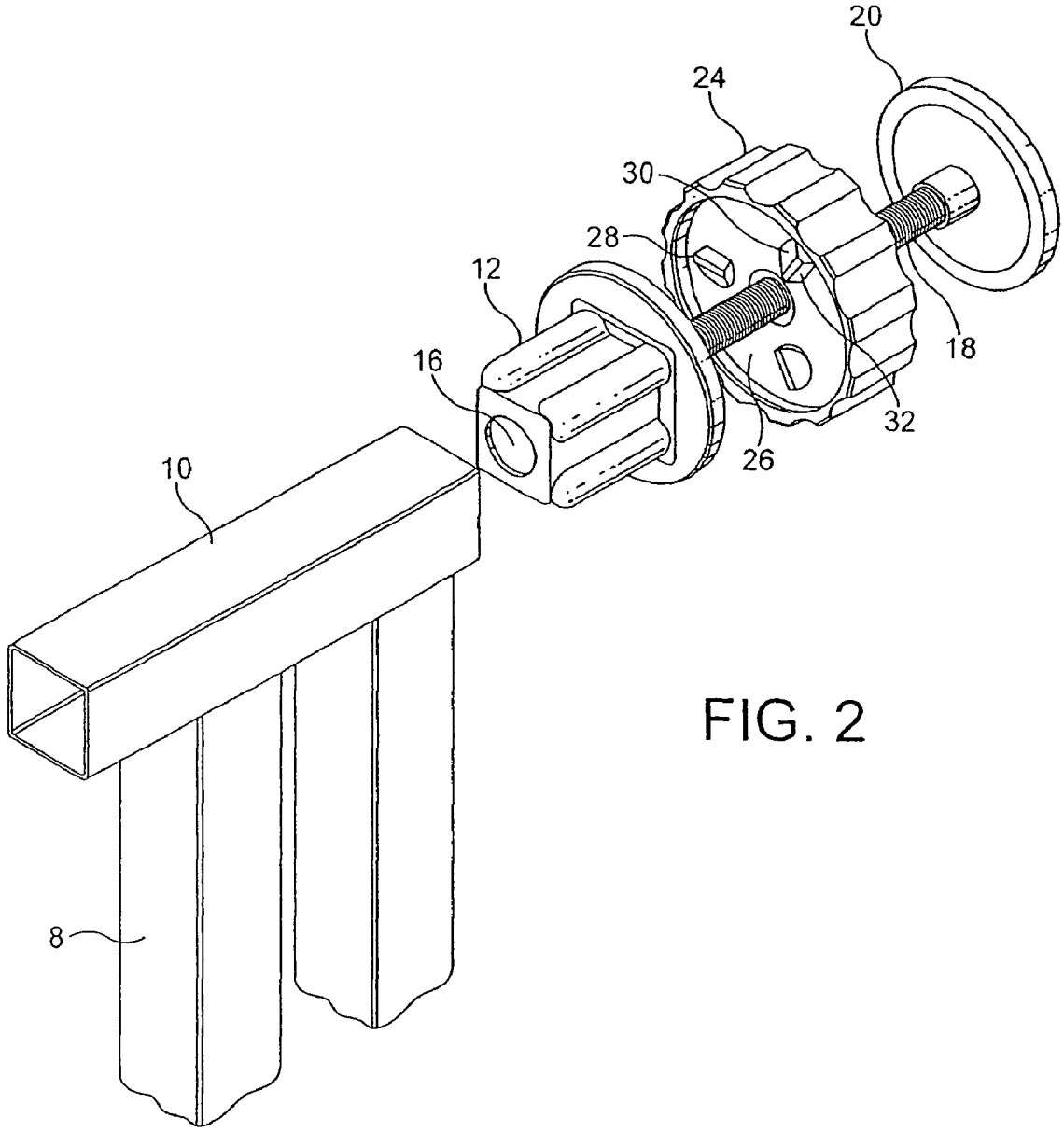
FIG. 2 is a scrap perspective exploded view of the same components as those shown in FIG. 1, but from the other side.
Figure 3:
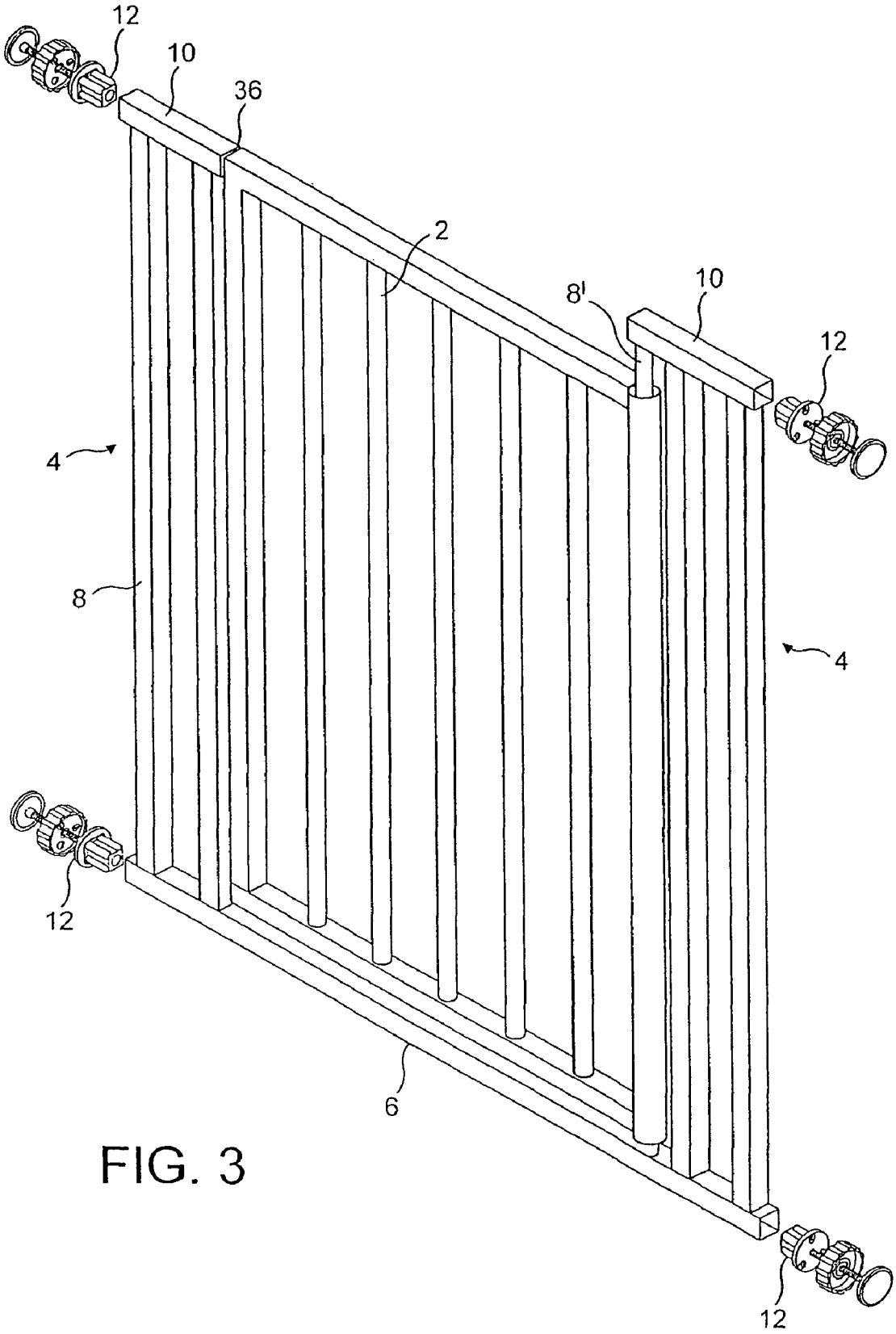
FIG. 3 is a perspective and partly exploded view of the child gate of which only a portion is shown in FIGS. 1 and 2.

As best seen in FIG. 3, the child gate comprises a U-shaped frame defining a central aperture in which a gate 2 is pivotally received. The frame comprises two side portions 4 which are connected together by a base 6. Each side portion 4 comprises vertical spaced bars 8 which are connected at their lower ends by the bar 6 and at their upper ends by a respective bar 10. One of the bars 8' of one of the side portions 4 constitutes a pivotal mounting for the gate 2. The gate 2 may be secured in the closed position shown in FIG. 3 by a child proof latch, which may be of any conventional type and which is not shown in FIG. 3 for the sake of clarity. The bars 10 and 6 constitute open-ended rectangular steel sections, accommodated in the open end of each of which as a push or force fit is a fitting 12 of moulded plastics material, in this case ABS, which will be described in more detail below. Each fitting 12 carries a width adjusting mechanism, which will be described below in relation to FIGS. 1 and 2.

Figure 1:
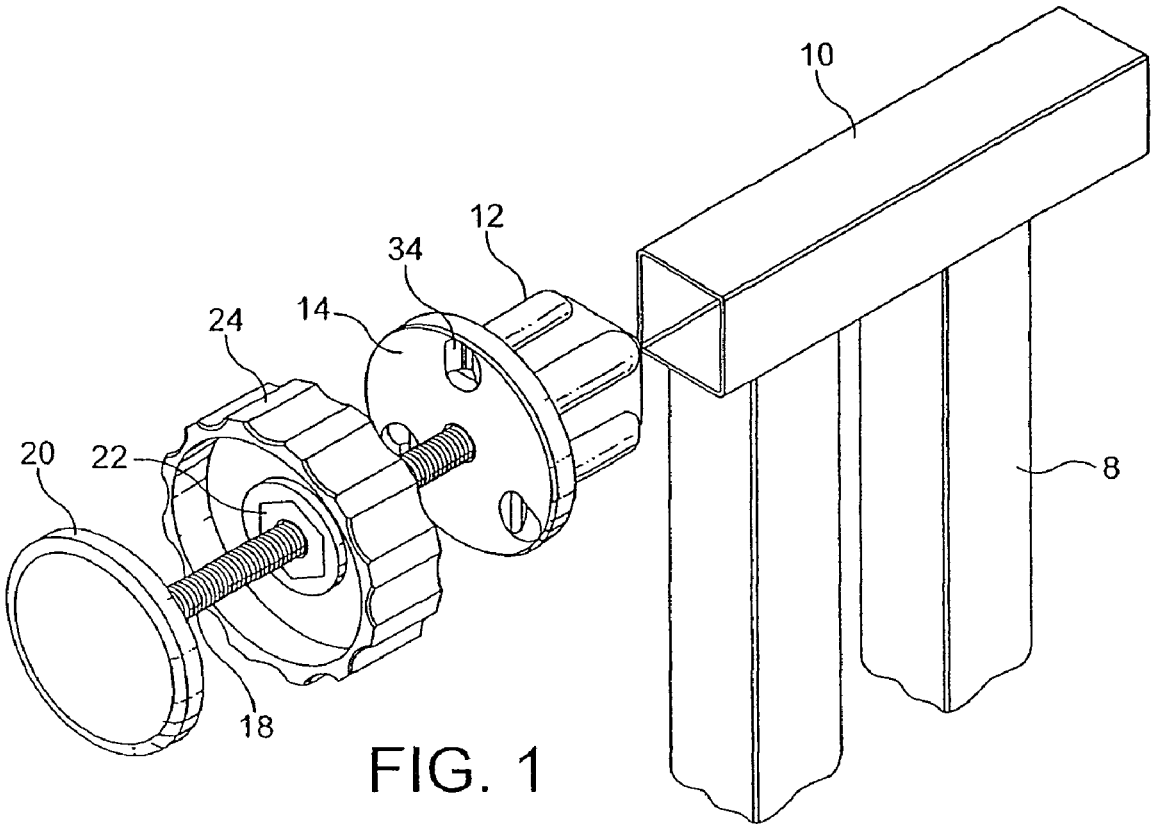
FIG. 1 is an exploded scrap perspective view of one top corner of the child barrier, which in this case constitutes a gate, in accordance with the invention.

As shown in FIGS. 1 and 2, each fitting 12 affords an outer planar surface 14, formed in the centre of which is a hole 16, which extends centrally through that portion of the fitting which is accommodated within the associated bar 10. Slidably received within the hole 16 is an elongate threaded member 18. Carried at the outer end of the member 18 is an abutment member 20, that is to say a pad or buffer which, in use, engages the surface of an adjacent wall defining the passage which is to be blocked by the barrier. Threadedly carried on the threaded member 18 is a steel nut 22, which is embedded within an adjustment member 24, which is made of resilient plastic material such as ABS, whose outer periphery is knurled or ridged and is generally circular. The radial surface 26 of the adjustment member 24 opposed to the surface 14 on the fitting 12 is substantially planar. Formed on the surface 26 are three equiangularly spaced locking projections 28 whose side surfaces in the radial direction are perpendicular to the surface 26 and whose two end surfaces in the circumferential direction are inclined or ramped. One of the ramped surfaces 30 is inclined to the surface 26 at a relatively shallow angle of e.g. 15 to 35° whilst the other ramped surface 32 is inclined at a relatively steep angle of 35 to 90°. Formed in the surface 14 of the fitting 12 are three equiangularly spaced locking recesses 34 whose size, position and shape correspond to those of the projections 28.

In use, the gate is positioned in a passage or doorway in which it is to be secured and each of the adjustment mechanisms is tightened in turn. This is effected by rotating the adjustment wheel 24 so that it moves axially along the threaded member 18 until the surfaces 14 and 26 are in loose engagement. The rotation of the wheel 24 is continued and this progressively moves the threaded member 18, and thus the buffer 20 carried by it, outwardly until it engages the adjacent wall or portion of the door frame. As rotation of the adjustment wheel 24 continues, the contact pressure between the wheel 24 and fitting 12 increases. In practice, the projections 28 on the wheel 24 will slide over the surface 14 and then extend into the recesses 14. However, the gently inclined ramps 30 on the projections 28 are provided on the leading edges of the projections, in the tightening direction of the adjusting wheel 24 and the gently inclined ramp surfaces of the recesses 34 are provided in corresponding positions. Accordingly, these two ramp surfaces come into sliding engagement and exert a compressive force on the resilient material of the projections 28, thereby enabling the projections to slide out of the recesses and rotation of the adjusting wheel 24 to continue. However, the torque which is necessary to achieve this progressively increases and a point is reached at which further tightening rotation is impossible. Once all four adjustment mechanisms have been tightened in this manner, the gate is reliably secured in position.

If a child should attempt to undo or loosen the adjustment mechanisms, rotation of an adjustment wheel 24 will immediately result in the steeply inclined ramps 32 on the projections 28 coming into contact with the corresponding ramp surfaces of the recesses 34. Due to the steep angle of inclination of these surfaces, the compressive force exerted on the projections 28 in the axial direction is relatively small and the torque exerted by a child will be insufficient to cause the projections to ride out of the recesses 34. Accordingly, the projections 28 and recesses 34 together constitute what might be referred to as a child-proof rotary ratchet. However, an adult is capable of exerting a substantially greater torque and this is sufficient to enable the adjustment wheel to be unscrewed.

When the gate is closed, there will necessarily be a small gap, designated 36, between the top of the gate and the adjacent end of the upper bar 10. As the upper adjusting mechanisms are tightened, this gap will inherently get smaller because the side portions 4 of the frame will be bent inwardly by the force exerted by the adjustment mechanisms against the resilience of the lower bar 6. In practice, this is likely to mean that the bar 10 comes into contact with the upper portion of the gate 2. However, if the gate 2 is opened, after unlatching the child-proof latch, the pressure on the two upper rotary ratchets will be released by bending the upper portions of the frame inwards, thereby facilitating the release of the ratchets. There can, however, not be a similar pressure release on the two lower adjustment mechanisms and for this reason it is preferred that the dimensions of the locking projections and recesses in the axial direction of the associated threaded member is greater on the two upper adjustment mechanisms than on the two lower mechanisms. This relatively small difference in dimensions may be selected with regard to the mechanical properties of the barrier so that both the upper and lower adjustment mechanisms are approximately equally easy to release.

The invention claimed is:

1. A child barrier for installation in a passage comprising a frame with two side portions which, in use, are positioned adjacent the walls of the passage, each side portion carrying one or more vertically spaced abutment members for engagement with an adjacent wall, the abutment member(s) on at least one of the side portions being connected thereto by an adjustment mechanism, each adjustment mechanism comprising an elongate threaded member, one end of which is connected to the associated abutment member and the other end of which is longitudinally slidably received in the associated side portion, each adjustment mechanism also including an adjustment member in screw threaded engagement with the threaded member, the adjustment member and the associated side portion of the frame affording respective surfaces opposed to one another, on one of which there is at least one resilient locking projection and on the other of which there is at least one cooperating locking recess, at least one of the projection and recess having two inclined ramp surfaces extending in opposite circumferential directions of the threaded member, one of the ramp surfaces being inclined at a relatively shallow angle to a plane extending radially of the threaded member and the other ramp surface being inclined at a relatively steep angle thereto, whereby after the adjustment member has been tightened by rotating it in one direction until it is in sliding contact with the opposed surface on the frame, a substantially greater torque is required to rotate it in the opposite direction as a result of the engagement of the locking projection in the locking recess.

2. A barrier as claimed in claim 1 in which the two opposed surfaces carry a plurality of locking projections and locking recesses, respectively.

3. A barrier as claimed in claim 1 in which the shape of the at least one locking projection is complementary to that of the at least one locking recess.

4. A barrier as claimed in claim 1 in which the elongate threaded mechanism is slidably received in a hole formed in a fitting carried by the associated side portion of the frame.

5. A barrier as claimed in claim 4, in which the fitting is made of plastics material.

6. A barrier as claimed in claim 1 in which the adjustment member is made of plastics material.

7. A barrier as claimed in claim 1 in which the frame is of generally U-shape comprising two side portions connected by a base portion and defines an aperture in which a gate pivotally connected to one of the side portions is received.

8. A barrier as claimed in claim 7 in which the dimension of the locking projections and recesses in the axial direction of the threaded member is greater on the upper adjustment mechanism than on the lower adjustment mechanism.

* * * * *